United States Patent [19]

Alsch

[11] Patent Number: 4,503,412

[45] Date of Patent: Mar. 5, 1985

[54] STAR-DELTA-SWITCH

[75] Inventor: Gottfried Alsch, Vienna, Austria

[73] Assignee: Hubert Laurenz Naimer, Ascona, Switzerland

[21] Appl. No.: 473,044

[22] Filed: Mar. 7, 1983

[30] Foreign Application Priority Data

Mar. 25, 1982 [AT] Austria ..... 1173/82

[51] Int. Cl.[3] ..... H01H 9/20

[52] U.S. Cl. ..... 335/170; 200/14

[58] Field of Search ..... 200/12, 14, 11 A, 13, 200/4; 335/20, 168, 170

[56] References Cited

U.S. PATENT DOCUMENTS 2,608,624 8/1952 Goodrich ..... 200/12
3,251,956 5/1966 Rasor et al. ..... 200/14
3,488,611 1/1970 Harper ..... 335/170
3,539,736 11/1970 Naimer ..... 200/4
3,585,544 6/1971 Cleaveland et al. ..... 335/170
3,648,204 3/1972 Davies et al. ..... 335/170

*Primary Examiner*—J. R. Scott
*Attorney, Agent, or Firm*—Kurt Kelman

[57] ABSTRACT

A switching mechanism in a star-delta-switch with a rotatable and axially displaceable switch-shaft prevents rotation of the switch-shaft from the off- to the delta-connection position in the direction of rotation from the delta-connection to the off-position in one of the axial positions while axial displacement of the switch-shaft to another axial position enables the switch-shaft to be rotated from the off- to the delta-connection, rotation of the switch-shaft in the other axial position causing the switching mechanism to reset to the one axial position.

7 Claims, 12 Drawing Figures

Fig. 4
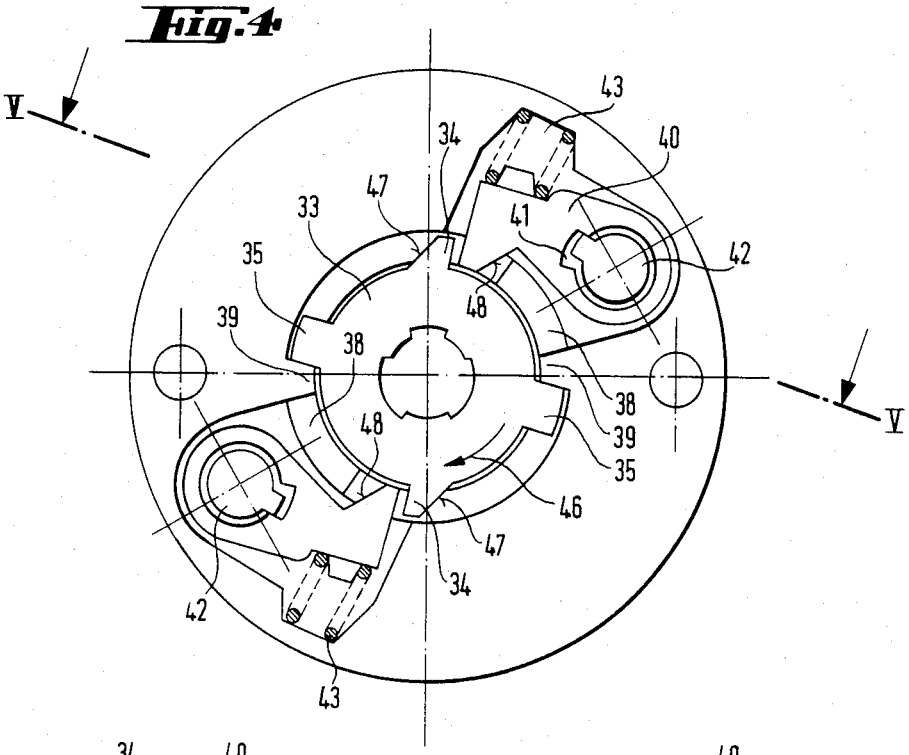
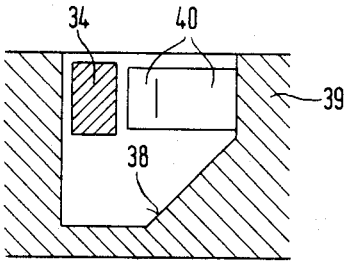
Fig. 5a
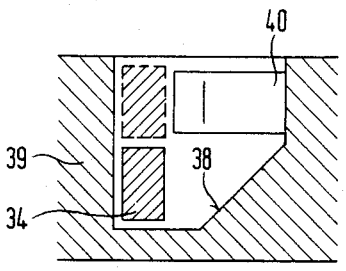
Fig. 5b
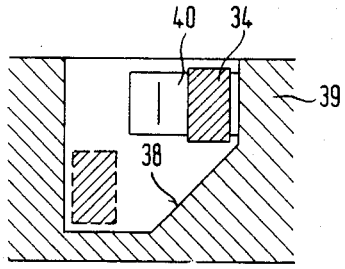
Fig. 5c
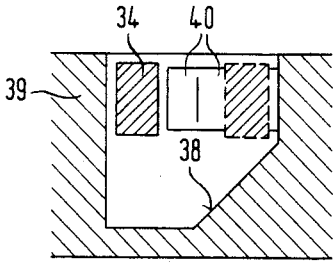
Fig. 5d 23
55
26
55
58
57
56
23
54
25
54
54
56
58
57
57
53
23
24
56
53
58
53

STAR-DELTA-SWITCH

BACKGROUND OF THE INVENTION

1. Field of the Invention

The invention refers to a star-delta-switch with a rotatable switch-shaft having a camshaft portion with cams for closing and, by this, closeable circuit-breaking contacts, delta-connection contacts and star-connection contacts which are closeable before the delta-connection contacts and a switch mechanism controlling the rotation of the switch-shaft.

2. Description of the Prior Art

In known star-delta switches, control of the contacts is effected solely by rotation of the camshaft. This has the disadvantage that, by quick operation of the switch for switching from the delta-connection position to the off-position, the time is not sufficient to extinguish the resulting arcs before the star-connection contacts close, whereby short circuits may occur. That is the reason why no-voltage release devices have very rarely been used with known star-delta-switches.

A star-delta-switch with a no-voltage release device has been proposed, but its construction is very expensive. This known switch has a ratchet clutch which connects a switch-shaft with cams operating the star-connection contacts, which permits these cams to be rotated with the switch-shaft only in the direction of turning-on. When the switch is turned off, these cams are not taken along so that a closure of the star-connection contacts cannot occur. The disadvantage of this known switch is its complicated construction, caused by the ratchet clutch.

It is also possible to switch from the delta-connection position to the star-connection position but this causes the opening of the circuit-breaking contacts so that a motor connected to the circuit comes to a standstill. When without switching into the off-position first, the switch is turned back into the delta-connection position, the circuit contacts are closed and the motor is started directly in the delta-connection.

A control switch with an axially displaceable, spring-biased shaft connected to cams is known but this switch is not a star-delta-switch but is useful only for switching from one switching position to an adjacent one. Therefore the cams of said known control switch are provided with control surfaces for each of the axial working positions of the cams with regard to the switch-bridges, said control surfaces taking effect during twisting said cams to handle in each of said axial working positions a switching program.

SUMMARY OF THE INVENTION

It is the object of the invention to provide a switch of the indicated type which avoids these disadvantages and is characterized by a simple construction.

This and other objects are accomplished according to this invention with a star-delta switch which comprises a switch-shaft rotatable about an axis thereof and having a camshaft section with contact operating cams, the switch-shaft being axially displaceable into two selected axial positions, a first one of the axial positions corresponding to a star-connection position and a second one of the axial positions corresponding to an off-position and a delta-connection, and spring means biasing the switch-shaft in the axial direction. Circuit breaking contact means, delta-connection contact means and star-connection contact means may be opened and closed by respective ones of the cams upon rotation of the switch-shaft in respective ones of the axial positions thereof, the circuit breaking contact means being open in the off-position and the star-connection contact means being closable before the delta-connection contact means. A switching mechanism effective in the second axial position of the switch-shaft includes a retaining disc mounted on the switch-shaft axially spaced from the cam shaft section for rotation with the switch-shaft, the retaining disc having a projection, a spring-biased retaining pawl pivotal about a fixed axis, the projection and the retaining pawl being coplanar in the second axial position wherein the spring-biased retaining pawl is pivoted into engagement with the projection and the projection subtending the retaining pawl in the first axial position, and a fixed guideway surface inclined towards the switch-shaft axis for guiding the projection, the fixed guideway surface rising in a direction of rotation of the switch-shaft from a plane corresponding to the second axial position thereof to a plane corresponding to the first axial position. The projection and the retaining pawl have matching oblique surfaces inclined with respect to the radius of the retaining disc in the direction of rotation from the delta-connection to the off-position whereby the switch-shaft and the retaining disc may be rotated from the delta-connection to the off-position in the second axial position, and the engaging projection and retaining pawl prevent rotation of the switch-shaft in the opposite direction from the off- to the delta-connection position in the second axial position of the switch-shaft while axial displacement of the switch-shaft and the retaining disc from the second to the first axial position causes the projection to subtend the retaining pawl whereby the projection is disengaged from the retaining pawl and the switch-shaft may be rotated from the off- to the delta-connection position in the first axial position of the switch-shaft, rotation of the retaining disc causing the projection to rise along the fixed guideway surface of the switching mechanism to return to the plane corresponding to the second axial position.

Preferably, the switch-shaft is connected to a no-voltage release device.

When such a switch is turned on, it will always close the circuit-breaking contacts and subsequently open the star-connection contacts but it may be selectively turned off from the delta-connection position via the star-connection position or directly to the off-position, whereby a suitable construction of the cams eliminates a closure of the star-connection contacts in the latter case. This also makes it possible to turn off the switch by safety devices, such as a no-voltage release device, this term also including under-voltage release devices or similar safety devices.

Furthermore, the construction of the switch according to the invention easily permits the star-connection position to be constructed as an unnotched position so that an extended, unintended operation of an installation, e.g. a motor, to be controlled by the switch in the star-connection is securely prevented.

BRIEF DESCRIPTION OF THE DRAWING

The invention will now be further explained in connection with the drawing wherein

FIG. 4 shows an end view of the switching mechanism;

FIGS. 5*a* to 5*d* are fragmentary sectional views of the switching mechanism along line V—V of FIG. 4, showing different positions during a switching cycle;

DESCRIPTION OF THE PREFERRED EMBODIMENTS

Figure 1:
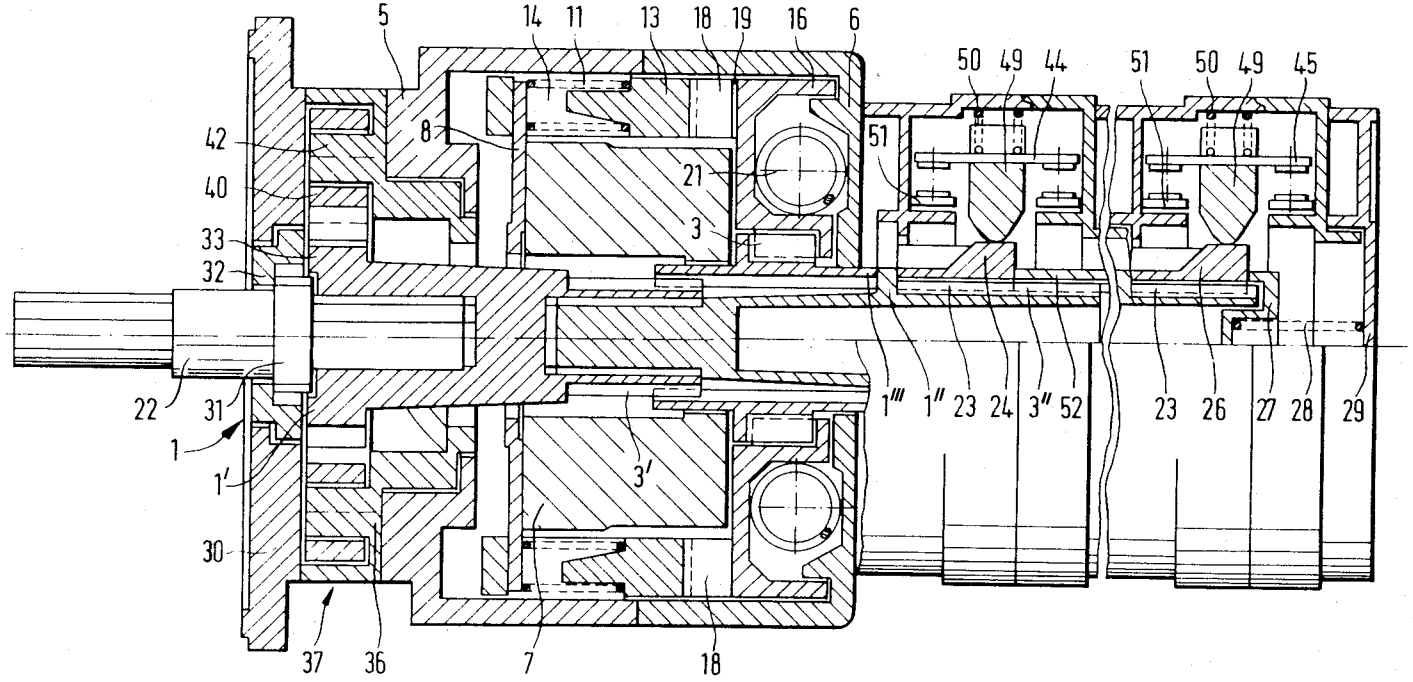
FIGS. 1 and 2 show an axial section, partly in side elevation, of a switch according to the invention, respectively, in its off- and -star position.
Figure 2:
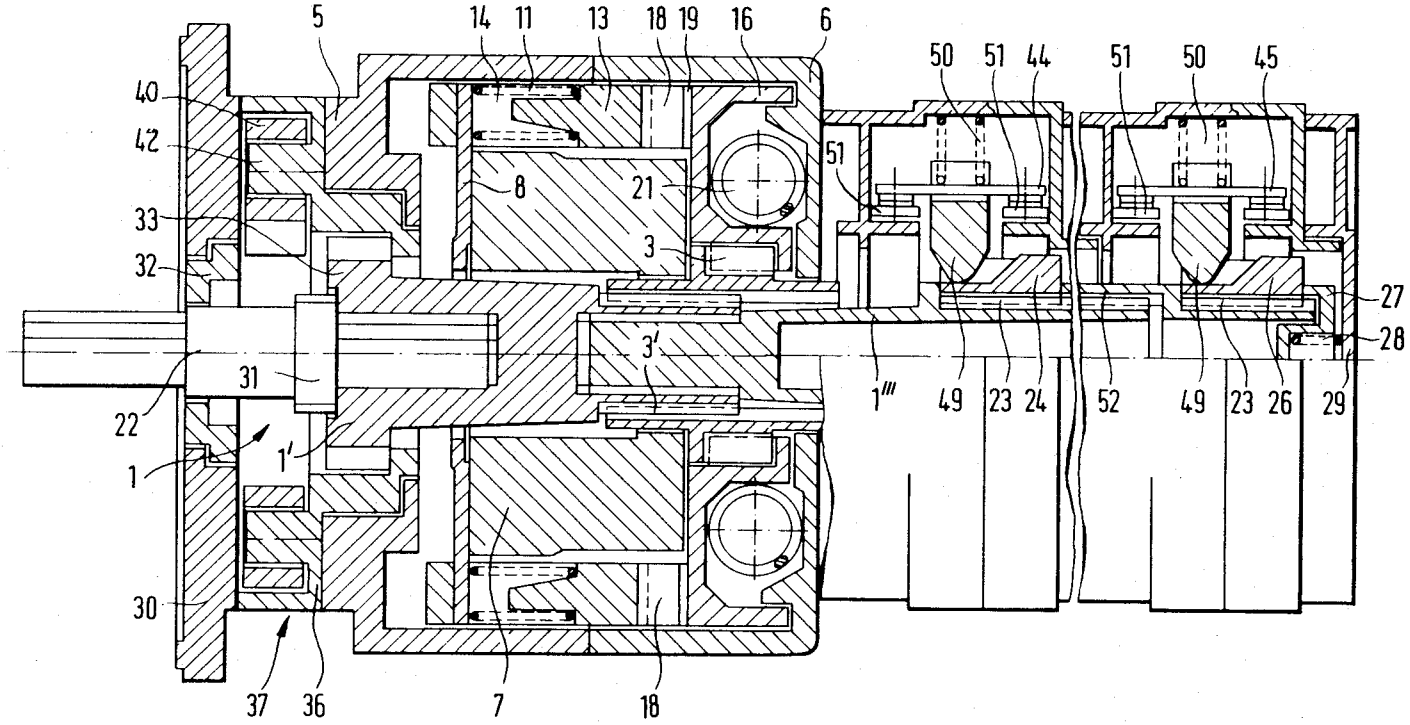

As shown in FIGS. 1 and 2, switch 2 comprises multiple-part switch-shaft 1. A hand grip may be mounted on control shaft 22 which is keyed to part 1′ of switch-shaft 1 by meshing splines and congruent keyways to provide a connection holding control shaft 22 and switch-shaft part 1′ against rotation relative to each other. A first toothed section 3′ and a second toothed section 3″ are provided on an extension of switch-shaft part 1′, of which the latter meshes with inner teeth 23 of part 1″, which is a camshaft, and the former meshes with part 1‴ of switch-shaft 1. Camshaft part 1″ has an outer toothed section and cams 24, 25, 26 and spacers 52 are slid over toothed section 3″. Cup-shaped end piece 27 is pushed over the end of shaft 1 and compression spring 28 projects into the bottom 29 of shaft end piece 27 and presses shaft 1 against housing cover 30 of the switch. Switch-shaft 1 is supported on the cover by collar 31 of control shaft 22 engaging intermediate cover part 32.

Figure 3:
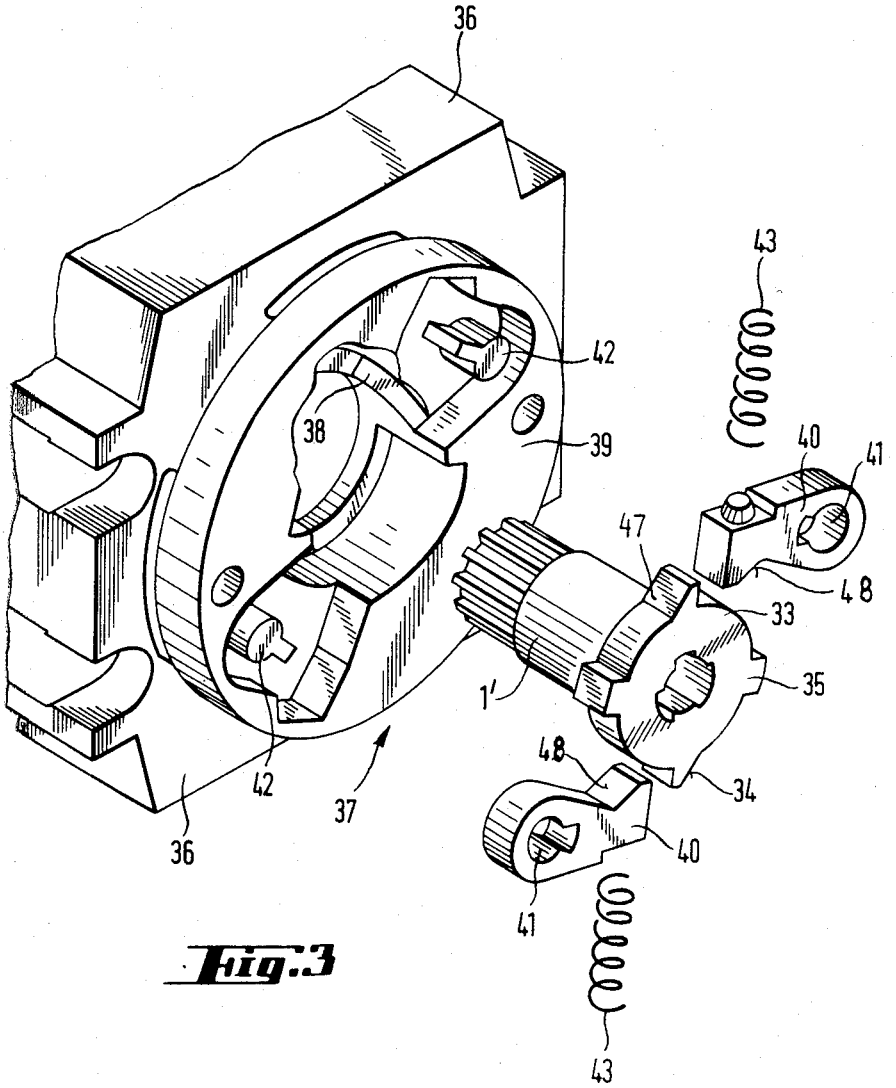
FIG. 3 shows an exploded perspective view of the switching mechanism.

Part 1′ of switch-shaft 1 carries retaining disc 33 which is shown to be integrally formed therewith. This retaining disc, as can be seen in FIGS. 3 and 4, is equipped with two radially extending saw-tooth profiled projections 34 and two further radially extending projections 35. During switching, these projections come into contact with guideway surfaces 38 inside housing 36 of switching mechanism 37 and glide therealong. Projections 35 also act to define the off-position of the switch when they engage stops 39 in housing 36. The saw-tooth formed projections 34 form a retaining gear with two retaining pawls 40, the more or less radially extending surfaces of saw-tooth formed projections 34 and retaining pawls 40 facing each other in the off-position of the switch. This provides an extremely compact construction of the switch mechanism in which one projection cooperates with the guideway surface and the retaining pawl while the other one, which preferably has radially extending surfaces, cooperates with a fixed stop in the housing of the switching mechanism to define the off-position. The radial extension of projections 35 provides an extremely packed construction in axial direction and assures a fixed definition of the off-position.

The retaining pawls 40 define bores 41 which engage pivots 42 on housing 36 and the pawls are pivotal around an axis defined by pivots 42 against the force of springs 43.

FIGS. 5*a* to 5*d* show diagrammatically the movement of saw-toothed formed projections 34 during a switching cycle. FIG. 5*a* shows the position of the retaining pawl 40 and the saw-tooth formed projection 34 in the off-position of the switch, as also shown in FIG. 4. When switch-shaft 1 is pushed down against the force of compression spring 28, whereby circuit contacts 45 and star-connection contacts 44 are closed (see FIG. 2), saw-tooth formed projections 34 take the position shown in FIG. 5*b* in which the previous position of saw-tooth formed projections 34 is shown in broken lines.

When switch-shaft 1 is turned in the direction of arrow 46 (FIG. 4) in the depressed position, in the retaining disc with its saw-tooth formed projections is pressed under the lower edge of retaining pawls 40, the saw-tooth formed projections 34 move under retaining pawls 40 and upwards along guideway surfaces 38 behind the retaining pawls, as one can see in FIG. 5*c*, and are finally positioned in a plane corresponding to the off- and delta-connection positions, in which switch-shaft 1 is pressed against housing cover 30 of the switch by compression spring 28. This causes, as will be explained later, the star-connection contacts 44 to be opened and afterwards the delta-connection contacts (not shown) to be closed, circuit contacts 45 staying closed. When turning off, e.g. when switch-shaft 1 is turned in a direction opposite to that of arrow 46, the shaft need not be depressed and may be turned in the plane corresponding to the delta-connection and off-position, as shown in FIG. 5*d*. In this position, obliquely extending surfaces 47 of saw-tooth formed projections 34 engage matching surfaces 48 of retaining pawls 40, whereby the retaining pawls are pressed outwards against the force of springs 43 and surfaces 47 and 48 glide by each other. As will be explained later, this turning causes the opening of circuit contacts 45 and of the delta-connection contacts, without the star-connection contacts 44 being opened and closed in the meantime.

Figures 6A, 6B, 6C:
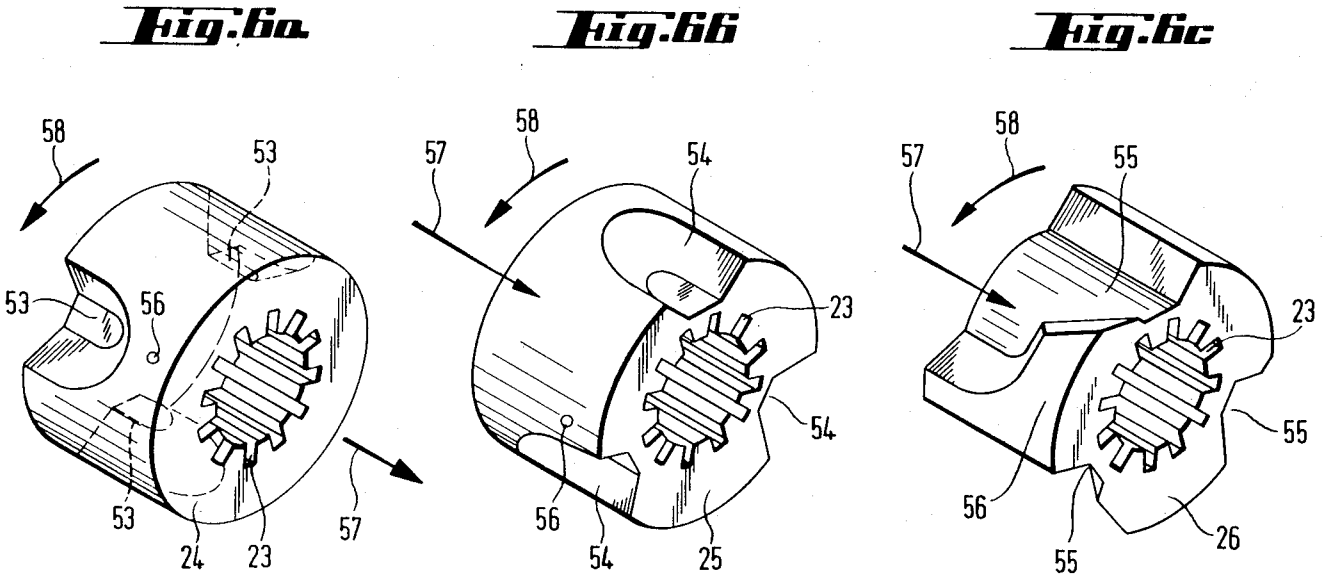
FIGS. 6*a* to 6*c* show perspective views of the switch cams.

As can be seen in FIGS. 1 and 2, contacts 44, 45 as well as the non-illustrated delta-connection contacts, which have the same structure as the star-connection and circuit contacts, are operated by tappets 49 which are able to lift the contacts off fixed contacts 51, contacts 44, 45 being constructed as bridges and these contact bridges being biased against the fixed contacts by compression springs 50. The tappets 49 are radially moveable in relation to switch-shaft 1 in guideways not shown in FIGS. 1 and 2, their movement being controlled by cams 24 to 26 shown in FIGS. 6*a* to 6*c*, points 56 of engagement of the tappets with the cams lying in an axially extending line and arrows 57 showing the direction in which cams 24 to 26 are displaced by depressing switch-shaft 1. The inner teeth 23 of cams 24 to 26 mesh with toothed section 3″ of switch-shaft part 1″. Every cam 24 to 26 has three similar control slots 53, 54, 55 distributed over its periphery. Cam 24 with three control slots 53 is used for operating star-connection contacts 44, cam 25 with three control slots 54 is used for operating the delta-connection contacts and cam 26 with three control slots 55 operates circuit contacts 45, three contacts with their tappets 49 being in one switch plane.

In the off-position of the switch, all tappets 49 rest on the cylindrical periphery of cams 24 to 26 so that all contacts are open (FIG. 1). When switch-shaft 1 is depressed, cams 24 to 26 are moved in the direction of arrows 57, whereby tappets 49, which operate the star-connection and circuit contacts 44, 45, sink into control slots 53, 55, and the contacts 44, 45 are closed (FIG. 2), whereas tappets 49 operated by cam 25 stay supported on its cylindrical periphery so that the delta-connection contact stays open.

If, after having pressed down switch-shaft 1, it is turned in the direction of arrows 58, tappets 49 supported by cam 24 rise upwards along the oblique side walls of control slots 53 and lift contact bridges 44 and open the contacts. The tappets 49 supported by cam 26 slide along the bottoms of control slots 55, whereby the circuit contacts 45 stay closed. Simultaneously, continuous turning of switch-shaft 1 causes a movement of the switch-shaft in axial direction in a direction opposite to that of arrows 57 by the sliding of projections 34 of the retaining disc 33 along the guideway surface 38. This axial movement is superimposed on the turning movement of the switch-shaft and causes tappets 49 operating the delta-connection contacts (not shown) to sink into control slots 54 of cam 25, whereby the delta-connection contacts are closed. If switch-shaft 1 is turned from the delta-connection position into the off-position without pressing down the switch-shaft, tappets 49, which control the delta-connection and circuit contacts, rise upwards along control slots 54, 55 of cams 25, 26 and open the contacts. The tappets 49, which control the star-connection contacts, slide along the cylindrical periphery of cam 24 and the star-connection contacts stay open.

Figure 7:
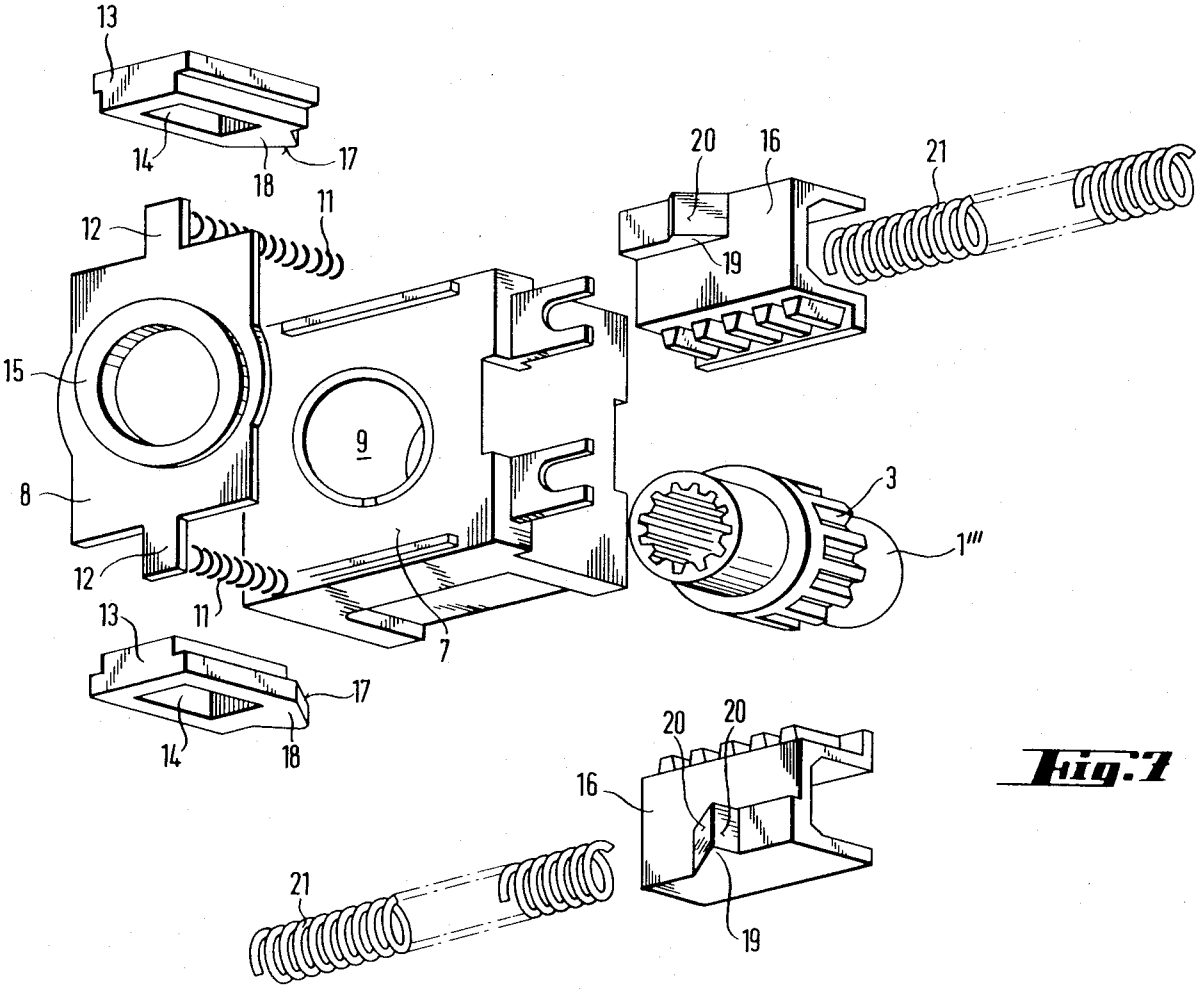
FIG. 7 shows an exploded perspective view of a no-voltage release device.

FIG. 7 shows an embodiment of a no-voltage release device. This consists essentially of a pot magnet 7 and associated armature 8 held in suitable grooves in casing halves 5, 6, core 9 of the magnet defining a bore receiving switch-shaft parts 1'' and 1'''. The coil of magnet 7 is preferably supplied from the circuit by a bridge rectifier. The armature 8 has lugs 12 which engage recesses 14 of blocking tappets 13 guided in grooves of casing half 5 and displaceable in the direction of the longitudinal axis of switch-shaft 1. The blocking tappets 13 are supported on armature 8 by compression springs 11 resting against lugs 12, different stresses of compression springs 11 being obtained when armature 8 is pulled up or displaced away from the magnet. To assure a release of armature 8 if the circuit does not attain minimum voltage, boss 15 is provided on armature 8 on the side thereof opposite to core 9 of pot magnet 7, which assures the necessary air gap. The blocking tappets 13 are pressed against restoring elements 16 by compression springs 11, the restoring elements being connected with switch-shaft by gear 3 for movement therewith, blocking tappets 13 being provided with projection 18 having oblique faces 17, with which they can be brought into engagement with projections 19 of restoring elements 16 extending in the axial direction of switch-shaft 1. These projections 19 also have oblique faces 20 whose angles are complementary to those of faces 17 of projections 18 of blocking tappets 13 to total approximately 90°.

If desired, an auxiliary switch (not shown) may be connected to the circuit of the magnet ahead of the contacts of the main switch, the auxiliary switch being operated to close the circuit when the main switch is switched away from its starting position. Such an auxiliary switch causes the circuit of the coil to be interrupted in the starting position of the main switch so that no electric energy is used in the starting position. It is advantageous if the closing of this auxiliary switch takes place immediately after switching away from the starting position of the main switch, in order to effect attraction of armature 8 by magnet 7 by low magnetic forces and to prevent compression springs 11 from being tensioned during the attraction of the armature 8 for which purpose large magnetic forces would be necessary when armature 8 is released. The oblique faces 20 of restoring elements 16 engage faces 17 of blocking tappets 13 only when magnet 7 has attracted armature 8 and large holding forces of magnet 7 are effective, and these faces slide along on one another, compression springs 11, which are supported by projections 12 of armature 8 and blocking tappets 13, being tensioned or overridden. Since, in the starting position of the switch and the restoring elements, oblique faces 20 of projections 19 of restoring elements 16 do not touch faces 17 of blocking tappets 13 and, consequently, the unit comprising armature 8, compression springs 11 and blocking tappets 13 is freely moveable over the range of its possible stroke, magnet 7, when excited, can move armature 8 with a low pulling force. On the other hand, in a switch position differing from the starting position of the switch and the restoring or resetting device, oblique faces 20 of restoring elements 16 engage oblique faces 17 of blocking tappets 13 against restoring elements 16. As long as the magnet is excited and its holding force is capable of keeping compression springs 11 compressed, projections 19 of restoring elements 16 engaging projections 18 of blocking tappets 13 prevent the restoring elements 16 from being able to turn switch-shaft 1 back into the starting position, despite the load applied by the tensioned compression springs 21, so that the resetting device remains in a switching position different from the starting position and defines the rest position of the delta-connection position of the main switch, the striking of restoring elements 16 against the casing wall and/or engagement of stops 39 of housing 36 of switching mechanism 37 with projections 35 of retaining disc 33 preventing the switch-shaft from turning beyond the delta-connection position (FIGS. 3 and 4). If in this position the holding force of magnet 7 decreases by a decrease or discontinuance of voltage supply to the magnet coil until this force is no longer sufficient to absorb the force exerted by compression springs 11 and blocking tappets 13, which are also biased by compression springs 21 via oblique faces 17 of their projections 18 and faces 20 of projections 19 of the restoring elements 16, armature 8 is released and the tension of compression springs 11 and also the blocking effect of blocking tappets 13 acting on the restoring elements decreases. The force of springs 21 is then sufficient to turn the restoring elements 16 and thereby switch-shaft 1 back into its starting position by overpowering the contact forces of the switch.

Such a no-voltage release device defines the off-position and the delta-connection position as rest positions, the off-position being defined by the force of the spring of the no-voltage release device and a stop with which the restoring element of the no-voltage release device or a part non-rotatably connected to the camshaft may be engaged under the bias of the spring. The delta-connection position, on the other hand, is defined by the restoring elements and the blocking tappets operated by the armature of the no-voltage release device, locking occurring only when a sufficiently high voltage is applied to the no-voltage release device.

The restoring elements 16 are racks which mesh with gearing 3 of part 1''' of switch-shaft 1 and are engaged by compression springs 21 supported on casing half 6. In the illustrated embodiment, springs 21 of both restoring elements are compressed and tensioned when switch-shaft 1 is thrust out of its position corresponding to the starting position of the switch. The no-voltage release device is fixedly mounted on the switch housing and the racks 16 have a length corresponding to the length of the axial displacement path of the switch-shaft. This provides a very simple switch construction.

I claim:

1. A star-delta switch comprising (a) a switch-shaft rotatable about an axis thereof and having a camshaft section with contact operating cams, the switch-shaft being axially displaceable into two selected axial positions, a first one of the axial positions corresponding to a star-connection position and a second one of the axial positions corresponding to an off- and delta-connection position, (b) spring means biasing the switch-shaft in the axial direction, (c) circuit breaking contact means, delta-connection contact means and star-connection contact means which may be opened and closed by respective ones of the cams upon rotation of the switch-shaft in respective ones of the axial positions thereof, the circuit breaking contact means being open in the off-position and the star-connection contact means being closable before the delta-connection contact means, and (d) a switching mechanism effective in the second axial position of the switch-shaft and including (1) a retaining disc mounted on the switch-shaft axially spaced from the cam shaft section for rotation with the switch-shaft, the retaining disc having a projection, (2) a spring-biased retaining pawl pivotal about a fixed axis, the projection and the retaining pawl being coplanar in the second axial position wherein the spring-biased retaining pawl is pivoted into engagement with the projection and the projection subtending the retaining pawl in the first axial position, and (3) a fixed guideway surface inclined towards the switch-shaft axis for guiding the projection, the fixed guideway surface rising in a direction of rotation of the switch-shaft from a plane corresponding to the second axial position thereof to a plane corresponding to the first axial position, (4) the projection and the retaining pawl having matching oblique surfaces inclined with respect to the radius of the retaining disc in the direction of rotation from the delta-connection to the off-position whereby the switch-shaft and the retaining disc may be rotated from the delta-connection to the off-position in the second axial position, and (5) the engaging projection and retaining pawl preventing rotation of the switch-shaft in the opposite direction from the off- to the delta-connection position in the second axial position of the switch-shaft while axial displacement of the switch-shaft and the retaining disc from the second to the first axial position causes the projection to subtend the retaining pawl whereby the projection is disengaged from the retaining pawl and the switch-shaft may be rotated from the off- to the delta-connection position in the first axial position of the switch-shaft, rotation of the retaining disc causing the projection to rise along the fixed guideway surface of the switching mechanism to return to the plane corresponding to the second axial position.

2. The star-delta switch of claim 1, wherein the fixed guideway surface is helical.

3. The star-delta switch of claim 1, wherein the retaining disc has another projection, and further comprising a stop arranged to be engaged by the other projection to define the off-position.

4. The star-delta switch of claim 3, wherein the other projection extends substantially radially from the retaining disc.

5. The star-delta switch of claim 1, further comprising a no-voltage release device connected to the switch-shaft.

6. The star-delta switch of claim 5, wherein the no-voltage release device comprises an electromagnet and an armature respectively attracted to, and released from, the electromagnet upon energization of the electromagnet, a blocking tappet connected to, and moving with, the armature upon attraction to, and release from, the electromagnet, a restoring element engaging the switch-shaft for movement therewith, and a spring supported by the restoring element and extending tangentially to the switch-shaft, the restoring element being arranged to be held by the blocking tappet in a position wherein the spring is loaded in a direction extending in the direction of the circumference of the switch-shaft when the armature is attracted to the electromagnet.

7. The star-delta switch of claim 6, further comprising a switch housing, the no-voltage release device being fixedly mounted on the switch housing, and a rack engaging the restoring element with the switch-shaft, the length of the rack corresponding to the length of the axial displacement path of the switch-shaft.

* * * * *